US011359329B2

(12) United States Patent
Yu et al.

(10) Patent No.: US 11,359,329 B2
(45) Date of Patent: Jun. 14, 2022

(54) DRYER APPLIANCE HAVING FLUID-VENTILATION FEATURES

(71) Applicant: Haier US Appliance Solutions, Inc., Wilmington, DE (US)

(72) Inventors: Zhiquan Yu, Mason, OH (US); Daniel Stephen Renz, Louisville, KY (US); Christopher Gene Vowels, Cox's Creek, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 113 days.

(21) Appl. No.: 16/807,294

(22) Filed: Mar. 3, 2020

(65) Prior Publication Data

US 2021/0277584 A1 Sep. 9, 2021

(51) Int. Cl.
*D06F 58/20* (2006.01)
*D06F 58/04* (2006.01)

(52) U.S. Cl.
CPC ..... *D06F 58/206* (2013.01); *D06F 58/04* (2013.01)

(58) Field of Classification Search
CPC ..... D06F 58/04; D06F 58/206; D06F 58/20
See application file for complete search history.

(56) References Cited

U.S. PATENT DOCUMENTS

| | | | | |
|---|---|---|---|---|
| 4,837,952 | A * | 6/1989 | Hennuy | D06F 75/18 38/77.7 |
| 9,568,244 | B2 | 2/2017 | Kim et al. | |
| 2007/0062665 | A1* | 3/2007 | Chen | B22D 27/04 164/122 |
| 2009/0120140 | A1* | 5/2009 | Choi | D06F 58/203 68/5 C |
| 2011/0107617 | A1* | 5/2011 | Lee | D06F 73/02 34/427 |
| 2013/0174435 | A1 | 7/2013 | Rockwell et al. | |
| 2018/0274160 | A1 | 9/2018 | Lowe | |

* cited by examiner

*Primary Examiner* — Edelmira Bosques
*Assistant Examiner* — Bao D Nguyen
(74) *Attorney, Agent, or Firm* — Dority & Manning, P.A.

(57) ABSTRACT

A dryer appliance, as provided herein, may include a cabinet, a drum, a drying chamber, and a supply duct. The cabinet may define an internal volume. The drum may be mounted within the cabinet. The drum may define a drying chamber, a dryer opening, an air inlet, and a fluid port. The drying chamber may extend from a front end to a rear end. The dryer opening may be defined at the front end to permit articles therethrough to the drying chamber. The air inlet may be defined at the rear end to permit air therethrough to the drying chamber. The fluid port may be spaced apart from the air inlet. The fluid port may extend from the drying chamber to the internal volume. The supply duct may extend within the cabinet to the drum upstream from the air inlet.

16 Claims, 5 Drawing Sheets

DRYER APPLIANCE HAVING FLUID-VENTILATION FEATURES

FIELD OF THE INVENTION

The present subject matter relates generally to dryer appliances, and more particularly to dryer appliances having one or more features for venting fluids (e.g., gases) from a drying chamber.

BACKGROUND OF THE INVENTION

Dryer appliances generally include a cabinet with a drum mounted therein. In many dryer appliances, a motor rotates the drum during operation of the dryer appliance (e.g., to tumble articles located within a chamber defined by the drum). Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler or blower is utilized to flow the internal air from the vent duct to the exhaust duct. When operating, the blower may pull air through itself from the vent duct, and this air may then flow from the blower to the exhaust conduit.

In rare instances, conditions within the drying chamber may reach an undesirable state. As an example, the temperature within the drying chamber may exceed an intended level. Such temperatures may cause damage to articles within the drying chamber or the dryer appliance itself. Under certain circumstances, excessive heat or pressure may escape through an opening typically covered by a door (e.g., during use), thus risking damage to the surrounding environment.

Accordingly, improved dryer appliances and methods for ventilating or otherwise managing elevated heat within the dryer appliances would be useful. In particular, dryer appliances having one or more features for safely exhausting hot gas or fluids from a drying chamber would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, a drying chamber, and a supply duct. The cabinet may define an internal volume. The drum may be mounted within the cabinet. The drum may define a drying chamber, a dryer opening, an air inlet, and a fluid port. The drying chamber may extend from a front end to a rear end. The dryer opening may be defined at the front end to permit articles therethrough to the drying chamber. The air inlet may be defined at the rear end to permit air therethrough to the drying chamber. The fluid port may be spaced apart from the air inlet. The fluid port may extend from the drying chamber to the internal volume. The supply duct may extend within the cabinet to the drum upstream from the air inlet.

In another exemplary aspect of the present disclosure, a dryer appliance is provided. The dryer appliance may include a cabinet, a drum, a drying chamber, and a supply duct. The cabinet may define an internal volume. The drum may be mounted within the cabinet. The drum may define a drying chamber, a dryer opening, an air inlet, a first port, and a second port. The drying chamber may extend from a front end to a rear end. The dryer opening may be defined at the front end to permit articles therethrough to the drying chamber. The air inlet may be defined at the rear end to permit air therethrough to the drying chamber. The fluid port may be spaced apart from the air inlet. The first port may extend from the drying chamber to the internal volume proximal from the rear end. The second port may be spaced apart from the first port and the air inlet. The second port may extend from the drying chamber to the internal volume in parallel with the first port. The supply duct may extend within the cabinet to the drum upstream from the air inlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
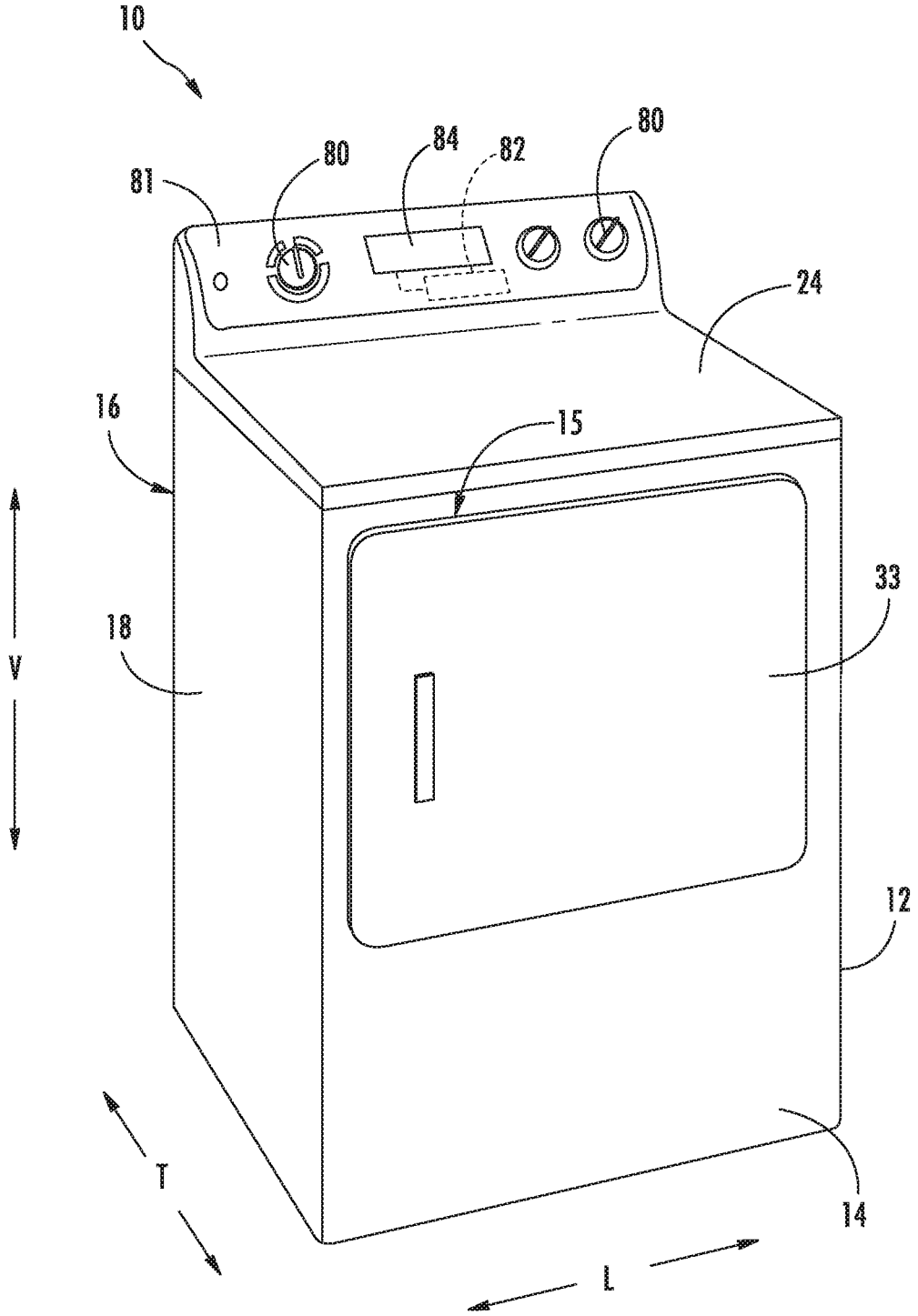
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
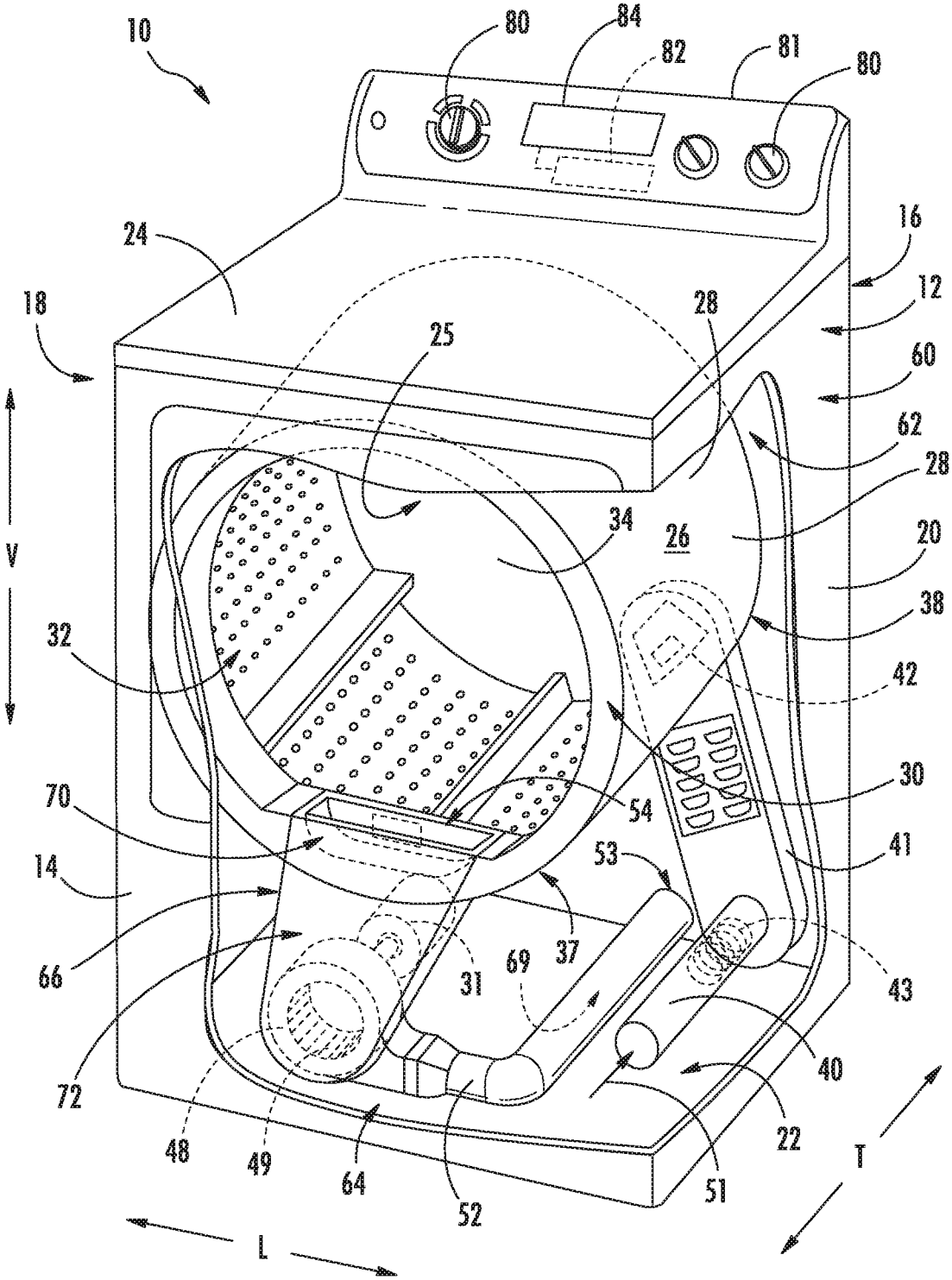
FIG. 2 provides a perspective view of the exemplary dryer appliance of FIG. 1, with portions of a cabinet of the dryer appliance removed to reveal certain components of the dryer appliance.
Figure 3:
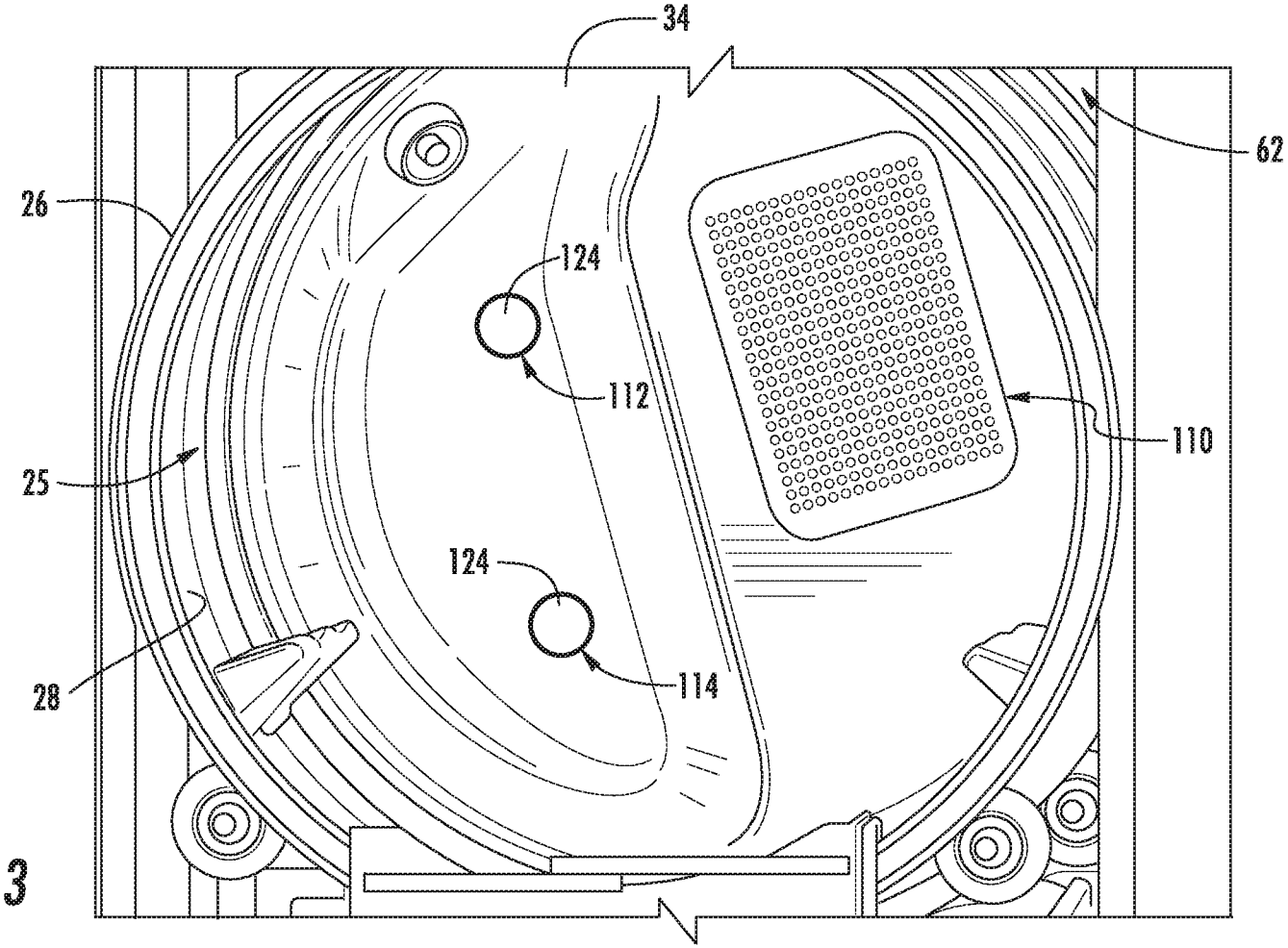
FIG. 3 provides a perspective view of a portion of an interior portion of the exemplary dryer appliance of FIG. 1, with various portions of the cabinet removed for clarity.
Figure 4:
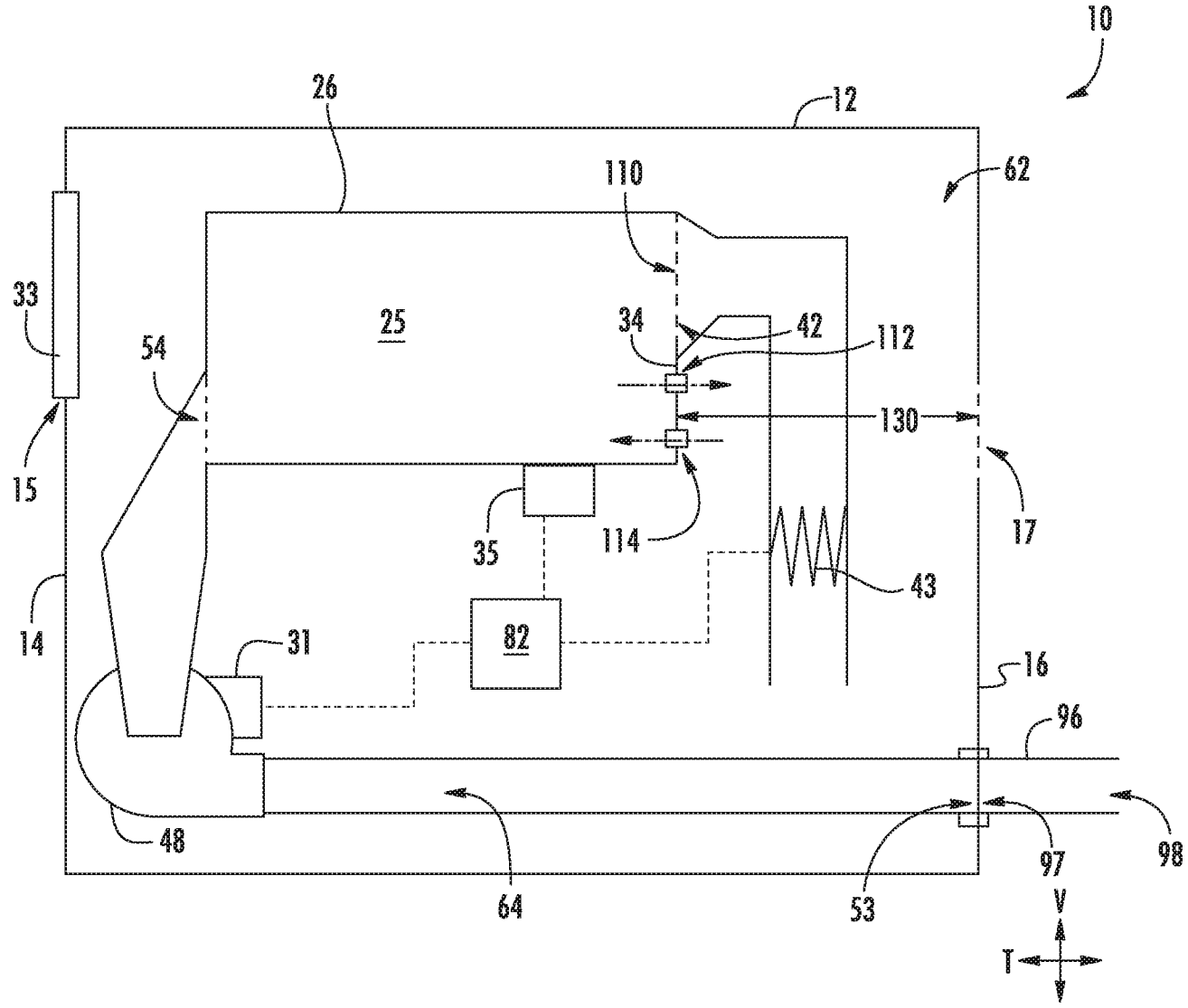
FIG. 4 provides a schematic view of various components of the exemplary dryer appliance of FIG. 1.
Figure 5:
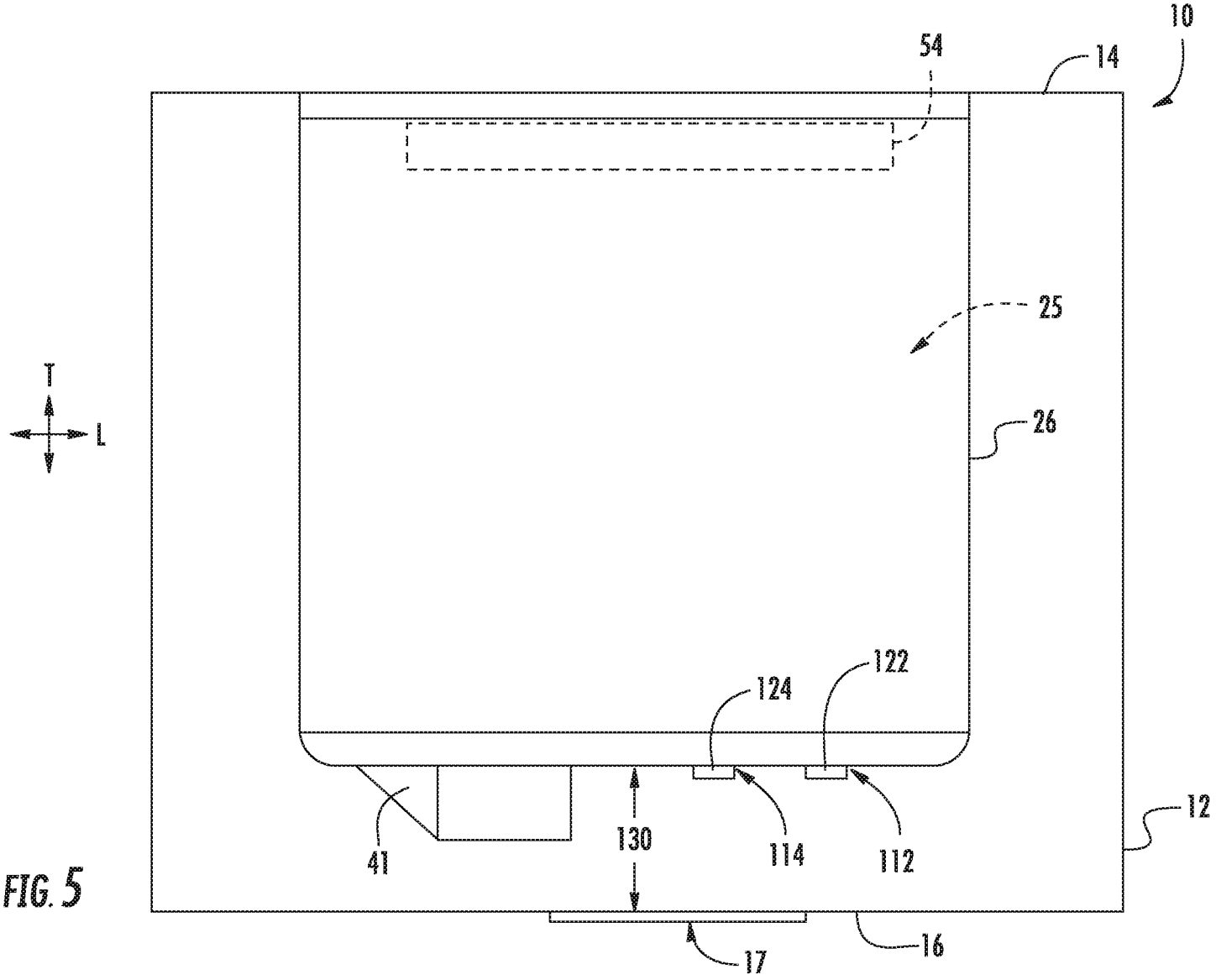
FIG. 5 provides a schematic, overhead, plan view of the exemplary dryer appliance of FIG. 1.

Turning now to the figures, FIG. 1 illustrates a dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. FIG. 3 provides a perspective view of an interior portion of dryer appliance 10 (e.g., within drum 26). FIG. 4 provides a schematic view of dryer appliance 10. FIG. 5 provides a schematic, overhead, plan view of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well.

Generally, dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. These panels can collectively define an external surface 60 of cabinet 12 and an interior 62 or internal volume 62 of cabinet 12. In some embodiments, one or more cabinet 12 openings are defined through cabinet 12. As an example, front panel 14 may define a front opening 15 through which articles may be received for drying. As an additional or alternative example, rear panel 16 may define a rear opening 17 in fluid communication with interior 62, such as to permit the exchange of air between the ambient environment and interior 62.

Within interior 62 of cabinet 12 is a drum or container 26. Drum 26 defines a chamber 25 for receipt of articles (e.g., clothing, linen, etc.) for drying. Drum 26 extends between a front end 37 and a rear portion 38 (e.g., along the transverse direction T). In exemplary embodiments, drum 26 is rotatable, for instance, about an axis that is parallel to the transverse direction T, within cabinet 12.

Drum 26 may be generally cylindrical in shape, having an outer cylindrical wall or cylinder 28 and a front wall 30 that may define a dryer opening or entry 32 of drum 26 (e.g., at front end 37 of drum 26) for loading and unloading of articles into and out of chamber 25 of drum 26. As shown, entry 32 may be aligned with an opening 15 of cabinet 12 through front panel 14, which is selectively covered by door 33. Opposite of the entry 32, drying chamber 25 may be substantially closed. For instance, drum 26 may include a back or rear wall 34 (e.g., at back end 38 of drum 26). As is generally understood, the front wall 30 and rear wall 34 remain generally stationary during operation of the dryer appliance 10. The cylinder 28 is rotatable relative to the drum 26 (including the front wall 30 and rear wall 34), such as about a central longitudinal axis of the cylinder 28 which in exemplary embodiments as shown extends parallel to the transverse direction T.

Although rear wall 34 is a generally solid or nonpermeable member (e.g., to prevent articles within the chamber 25 from falling out of the drum 26 at the back end 38), rear wall 34 may define one or more apertures. As shown, rear wall 34 may define an air inlet 110 at the rear end 38. Generally, air inlet 110 extends through rear wall 34 (e.g., along or parallel to the transverse direction T) to permit air therethrough and to the drying chamber 25. For instance, when assembled, air inlet 110 may be in fluid communication with a heating assembly 40, which may supply a drying airflow to drying chamber 25 through air inlet 110, as further described below. Optionally, a perforated cover or grate may be disposed across air inlet 110 (e.g., mounted to rear panel 16) to prevent the passage of articles through rear wall 34, while still permitting the passage of air to drying chamber 25.

Separate from or in addition to air inlet 110, one or more fluid ports 112, 114 may be defined through drum 26 to the drying chamber 25. For instance, such fluid ports 112, 114 may be spaced apart (e.g., vertically or laterally) from air inlet 110. Additionally or alternatively, the fluid ports 112, 114 may be positioned proximal to the rear end 38 (i.e., closer to rear end 38 than front end 37 along the transverse direction T). As will be described in greater detail below, each fluid port 112, 114 may extend from drying chamber 25 to the surrounding interior 62.

A blower motor 31 may be in mechanical communication with an air handler (e.g., blower 48). During certain operations, motor 31 may rotate a blower fan or impeller 49 of blower 48. Blower 48 is configured for drawing air through chamber 25 of drum 26 (e.g., in order to dry articles located therein). As illustrated in FIG. 4, dryer appliance 10 may include an additional motor (e.g., drum motor 35) in mechanical communication with drum 26. In turn, motor 35 may rotate drum independently of blower 48.

Drum 26 may be configured to receive heated air that has been heated by a heating assembly 40 (e.g., in order to dry damp articles disposed within chamber 25 of drum 26). Generally, heating assembly 40 includes a heater 43, such as a gas burner or an electrical resistance heating element, for heating air. As discussed above, during operation of dryer appliance 10, motor 31 rotates impeller 49 of blower 48 such that blower 48 draws air through chamber 25 of drum 26. In particular, ambient air enters heating assembly 40 via an entrance (e.g., as indicated at arrow 51) due to blower 48 urging such ambient air into entrance. Such ambient air is heated within heating assembly 40 and exits heating assembly 40 as heated air. Blower 48 draws such heated air through inlet duct 41 to drum 26. In particular, the heated air enters drum 26 through an outlet 42 of duct 41 and through air inlet 110 defined by drum 26. Thus, outlet 42 may be positioned at rear wall 34 of drum 26.

Within chamber 25, the heated air can remove moisture (e.g., from damp articles disposed within chamber 25). This internal air, in turn, flows from chamber 25 through a ventilation assembly 64 positioned within interior 62. Generally, ventilation assembly 64 includes an exhaust conduit 52 that defines an exhaust passage 69. Exhaust passage 69 is in fluid communication with the drying chamber 25 and extends from an inlet 54 at drying chamber 25 to an outlet 53 defined by cabinet 12. In some embodiments, the exhaust conduit 52 includes a vent duct 66, blower 48, and a ducted conduit 68. As shown, exhaust conduit 52 may be configured in fluid communication with vent duct 66 via blower 48. During a dry cycle, internal air flows from chamber 25 through vent duct 66 to blower 48 and through blower 48 to exhaust conduit 52. The internal air is then exhausted from dryer appliance 10 via the outlet 53.

In some embodiments, an external duct 96 is provided in fluid communication with exhaust conduit 52. For instance, external duct 96 may be attached (e.g., directly or indirectly attached) to cabinet 12 at rear panel 16. Any suitable connector (e.g., collar, clamp, etc.) may join external duct 96 to exhaust conduit 52. In turn, external duct 96 may be downstream from outlet 42. When assembled, duct inlet 97 is positioned proximate to cabinet 12 and outlet 42 while duct outlet 98 is positioned distal to cabinet 12. In residential environments, duct outlet 98 may be positioned at or in communication with an outdoor environment (e.g., outside of a home or building in which dryer appliance 10 is installed). During a dry cycle, internal air may thus flow from exhaust conduit 52 to duct inlet 97; and from duct inlet 97 to duct outlet 98, before being exhausted to the outdoor environment.

In exemplary embodiments, vent duct 66 may include a filter portion 70 and an exhaust portion 72. Exhaust portion 72 may be positioned downstream of filter portion 70 (in the direction of flow of the internal air). A screen filter of filter portion 70 (which may be removable) traps lint and other foreign materials as the internal air flows therethrough. The internal air may then flow through exhaust portion 72 and blower 48 to ducted conduit 68 and, subsequently, external duct 96. After the clothing articles have been dried, the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motors 31 and 35 and heating assembly 40 (including heater 43) in response to the position of selector inputs 80. Additionally, a display 84, such as an indicator light or a screen, may be provided on cabinet backsplash 81. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitive storage media) such as, for example, electrically erasable, programmable read only memory (EEPROM). The memory elements can store information accessible processing device, including instructions that can be executed by processing device. For example, the instructions can be software or any set of instructions that when executed by the processing device, cause the processing device to perform operations. In certain embodiments, the instructions include a software package configured to operate appliance 10.

As described above, one or more fluid ports 112, 114 may be defined through drum 26 proximal to rear end 38. In particular, each fluid port 112, 114 may be defined to be in simultaneous fluid communication with interior 62 and drying chamber 25 to permit air to pass from interior 62 to drying chamber 25, or vice versa. Thus, each fluid port 112, 114 may be defined in fluid communication between interior 62 and drying chamber 25. The fluid ports 112, 114 may be generally isolated from heating assembly 40. Thus, air may flow into drying chamber 25 through at least one fluid port (e.g., second fluid port 114) without first passing through heating assembly 40 or air inlet 110. During certain conditions (e.g., elevated heat conditions), air may be permitted to ventilate or equalize pressure between drying chamber 25 and interior 62 through fluid ports 112, 114. Advantageously, excessive heat, pressure, gas, or fumes may be prevented from accumulating within drying chamber 25. Additionally or alternatively, such heat, pressure, or fumes may be prevented from flowing through front opening 15, such as when a user opens door 33.

In some embodiments, multiple fluid ports, such as a first fluid port 112 and a second fluid port 114, are defined through a wall of drum 26. As shown, the fluid ports 112, 114 may be spaced apart from each other. For instance, first fluid port 112 may be disposed above second fluid port 114 (e.g., spaced apart along the vertical direction V). Additionally or alternatively, first fluid port 112 may be laterally offset from second fluid port 114 (e.g., spaced apart along the lateral direction L). Further additionally or alternatively, second fluid port 114 is further spaced apart from outer wall 28. In particular, second fluid port 114 may be spaced above a lowermost interior 62 surface of outer wall 28 (e.g., such that articles within drying chamber 25 are prevented from blocking or restricting second fluid port 114). In exemplary embodiments, the first fluid port 112 extends in fluid parallel or geometric parallel with the second fluid port 114. During certain conditions (e.g., elevated heat conditions), one portion of air may be permitted to flow to drying chamber 25 from interior 62 through one fluid port (e.g., second fluid port 114), while another portion of air simultaneously flows from drying chamber 25 to interior 62 through another fluid port (e.g., first fluid port 112). The air flow between interior 62 and drying chamber 25 may be motivated by natural convection or a separate fan or blower (not pictured) mounted within interior 62 (e.g., in fluid isolation from heating assembly 40). Irrespective of whether a separate fan or blower is provided, an exchange of heat, air, gas, or fumes through fluid ports 112, 114 (e.g., to/from chamber 25) may be advantageously controlled and directed away from a user at the front of dryer appliance 10.

As noted above, rear panel 16 may at least partially define the interior 62 within which drum 26 is mounted. In some embodiments, rear panel 16 is spaced apart from drum 26, and in particular, rear wall 34. For instance, rear panel 16 may be spaced apart (e.g., rearward) from rear wall 34 along the transverse direction T. Thus, an air gap 130 may be defined between at least a portion of rear wall 34 and an inner surface of rear panel 16. Moreover, air gap 130 may be defined in the space between the fluid ports 112, 114 and the rear panel 16 (e.g., and rear opening 17 defined through rear panel 16). Optionally, the air gap 130 may be greater than or equal to ten millimeters. Thus, the distance between fluid port 112, 114 and rear opening 17 is at least ten millimeters. Notably, air, gas, or fumes may be prevented from flowing directly from a fluid port 112, 114 to rear panel 16 or rear opening 17, which may installed be proximal or adjacent to a wall of building or residence.

In some embodiments, a plug 122, 124 is received within one or more of the fluid ports 112, 114. Optionally, each fluid port 112, 114 may receive a separate plug 122, 124. Thus, a first plug 122 may be received within first fluid port 112 while a second plug 124 is received within second fluid port 114. Generally, a plug 122 or 124 may block or restrict air through the corresponding fluid port 112 or 114. For instance, each plug 122 or 124 may be a solid, nonpermeable member that extends across the entire cross-section (e.g., cross-section lying in a vertical plane) of the corresponding fluid port 112 or 114. Thus, air may generally be prevented from passing through a corresponding fluid port 112 or 114 when plug 122 or 124 is received therein.

In some embodiments, plug 122, 124 is formed from an elastic material (e.g., polymer). The material and shape may be preselected such that a plug 122, 124 has a set melting temperature. In particular, the set melting temperature may be below the melting temperature of drum 26 (e.g., at rear wall 34). Optionally, the set melting temperature may be a temperature between 120° Celsius and 300° Celsius. Additionally or alternatively, the set melting temperature may be a temperature between 150° Celsius and 250° Celsius. Further additionally or alternatively, the set melting temperature may be about (e.g., within ten percent of) 170° Celsius. In embodiments wherein a different plug (e.g., first plug 122 or second plug 124) corresponds to a different fluid port (e.g., first fluid port 112 or second fluid port 114), the set melting temperature of each plug 122, 124 may be the same or, alternatively, different. During certain conditions (e.g., elevated heat conditions), one or more of the plugs 122, 124 may melt and flow away (e.g., out of) the corresponding port 112, 114; which in turn may permit air, gas, or fumes through port(s) 112, 114. Advantageously, the flow of air, gas, or fumes through port(s) 112, 114 (as described above) may be prevented until, for instance, the temperature within chamber 25 exceeds the set melting temperature(s).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:
a cabinet defining an internal volume;
a drum mounted within the cabinet, the drum defining
a drying chamber extending from a front end to a rear end,
a dryer opening at the front end to permit articles therethrough to the drying chamber,
an air inlet at the rear end to permit air therethrough to the drying chamber, and
a fluid port spaced apart from the air inlet, the fluid port extending from the drying chamber to the internal volume;
a supply duct extending within the cabinet to the drum upstream from the air inlet; and
a plug received within the fluid port to restrict air therethrough,
wherein the plug is a solid, nonpermeable member extending entirely across the fluid port to prevent fluid passage therethrough, and
wherein the plug has a melting temperature between 120° Celsius and 300° Celsius to melt away from the fluid port and permit one or more fluids therethrough to equalize pressure between the drying chamber and the internal volume.

2. The dryer appliance of claim 1, wherein the fluid port is first port, and wherein the drum further defines a second port spaced apart from the first port and the air inlet, the second port extending from the drying chamber to the internal volume.

3. The dryer appliance of claim 2, wherein the first port is disposed above the second port.

4. The dryer appliance of claim 2,
wherein the plug is a first plug, and wherein the dryer appliance further comprises:
a second plug received within the second port to restrict air therethrough.

5. The dryer appliance of claim 1, wherein the cabinet comprises a rear panel, and wherein the fluid port is spaced apart from the rear panel by an air gap greater than or equal to ten millimeters.

6. The dryer appliance of claim 5, wherein the rear panel defines a cabinet opening in fluid communication with the internal volume.

7. The dryer appliance of claim 1, wherein the drum comprises a rear support wall at the rear end, and wherein the fluid port is defined through the rear support wall.

8. The dryer appliance of claim 1, further comprising:
a ventilation assembly attached to the drum, the ventilation assembly comprising a conduit defining an exhaust passage in fluid communication with the drying chamber, the conduit extending from an inlet at the drying chamber to an outlet defined through the cabinet.

9. A dryer appliance comprising:
a cabinet defining an internal volume;
a drum mounted within the cabinet, the drum defining
a drying chamber extending from a front end to a rear end,
a dryer opening at the front end to permit articles therethrough to the drying chamber,
an air inlet at the rear end to permit air therethrough to the drying chamber, and
a first port spaced apart from the air inlet, the first port extending from the drying chamber to the internal volume proximal from the rear end, and
a second port spaced apart from the first port and the air inlet, the second port extending from the drying chamber to the internal volume in parallel with the first port, the second port being defined at a bottom half of the drum;
a supply duct extending within the cabinet to the drum upstream from the air inlet; and
a plug received within the first port to restrict air therethrough,
wherein the plug is a solid, nonpermeable member extending entirely across the first port to prevent fluid passage therethrough, and
wherein the plug has a melting temperature between 120° Celsius and 300° Celsius to melt away from the first port and permit one or more fluids therethrough to equalize pressure between the drying chamber and the internal volume.

10. The dryer appliance of claim 9, wherein the plug is a first plug, and wherein the dryer appliance further comprises:
a second plug received within the second port to restrict air therethrough.

11. The dryer appliance of claim 10, wherein the second plug has a melting temperature between 120° Celsius and 300° Celsius.

12. The dryer appliance of claim 9, wherein the first port is disposed above the second port.

13. The dryer appliance of claim 9, wherein the cabinet comprises a rear panel, and wherein the first port is spaced apart from the rear panel by an air gap greater than or equal to ten millimeters.

14. The dryer appliance of claim 13, wherein the rear panel defines a cabinet opening in fluid communication with the internal volume.

15. The dryer appliance of claim 9, wherein the drum comprises a rear support wall at the rear end, and wherein the first port and the second port are defined through the rear support wall.

16. The dryer appliance of claim 9, a ventilation assembly attached to the drum, the ventilation assembly comprising a conduit defining an exhaust passage in fluid communication with the drying chamber, the conduit extending from an inlet at the drying chamber to an outlet defined through the cabinet.

* * * * *